US006581228B1

(12) United States Patent
Boskovich et al.

(10) Patent No.: US 6,581,228 B1
(45) Date of Patent: Jun. 24, 2003

(54) PORTABLE CHANGING APPARATUS FOR AN INFANT

(76) Inventors: Mark O. Boskovich, 4205 Baldwin Ave., Culver City, CA (US) 90232; Norma I. Boskovich, 4205 Baldwin Ave., Culver City, CA (US) 90232

( * ) Notice: Subject to any disclaimer, the term of this patent is extended or adjusted under 35 U.S.C. 154(b) by 0 days.

(21) Appl. No.: 10/100,202

(22) Filed: Mar. 19, 2002

(51) Int. Cl.[7] ..... A47D 13/00; A47C 17/70

(52) U.S. Cl. ..... 5/655; 5/111; 5/113; 5/503.1; 108/115; 135/96

(58) Field of Search ..... 5/655, 110–114, 5/503.1, 658; 108/115; 135/96

(56) References Cited

U.S. PATENT DOCUMENTS 2,865,433 A * 12/1958 Warner ..... 5/653
3,462,773 A * 8/1969 Triplett ..... 108/115
5,265,289 A * 11/1993 Swiger et al. ..... 5/111
D367,771 S * 3/1996 Julian ..... D6/333
5,926,881 A * 7/1999 Madison ..... 5/655
6,295,669 B1 * 10/2001 Saus ..... 108/115
6,378,445 B1 * 4/2002 Willard, Sr. et al. ..... 108/115
6,389,624 B1 * 5/2002 Madole ..... 5/655

FOREIGN PATENT DOCUMENTS

GB 2137490 A * 10/1984 ..... 5/655

* cited by examiner

*Primary Examiner*—Alexander Grosz

(57) ABSTRACT

A portable changing apparatus for an infant for allowing a user to easily change diapers on a baby on outings, in particular. The portable changing apparatus for an infant includes a frame assembly capable of being folded; and also includes a leg assembly being attached to and foldable upon the frame assembly; and further includes a hinge assembly for folding the frame assembly and the leg assembly; and also includes a sheet of material being attached to the frame assembly and being adapted for an infant to lie upon; and further includes a hood member being attachable to the frame assembly; and also includes a storage unit being removably secured to the frame assembly; and further includes a child restraining member being adjustably attached to the frame assembly.

6 Claims, 4 Drawing Sheets

PORTABLE CHANGING APPARATUS FOR AN INFANT

BACKGROUND OF THE INVENTION

1. Field of the Invention

The present invention relates to portable diaper changing stations and more particularly pertains to a new portable changing apparatus for an infant for allowing a user to easily change diapers on a baby on outings, in particular.

2. Description of the Prior Art

The use of portable diaper changing stations is known in the prior art. More specifically, portable diaper changing stations heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,265,289; 5,926,881; 4,133,063; U.S. Pat. No. Des. 367,771; U.S. Pat. Nos. 5,845,349; and 5,615,433.

While these devices fulfill their respective, particular objectives and requirements, the aforementioned patents do not disclose a new portable changing apparatus for an infant. The inventive device includes a frame assembly capable of being folded; and also includes a leg assembly being attached to and foldable upon the frame assembly; and further includes a hinge assembly for folding the frame assembly and the leg assembly; and also includes a sheet of material being attached to the frame assembly and being adapted for an infant to lie upon; and further includes a hood member being attachable to the frame assembly; and also includes a storage unit being removably secured to the frame assembly; and further includes a child restraining member being adjustably attached to the frame assembly.

In these respects, the portable changing apparatus for an infant according to the present invention substantially departs from the conventional concepts and designs of the prior art, and in so doing provides an apparatus primarily developed for the purpose of allowing a user to easily change diapers on a baby on outings, in particular.

SUMMARY OF THE INVENTION

The general purpose of the present invention, which will be described subsequently in greater detail, is to provide a new portable changing apparatus for an infant which has many of the advantages of the portable diaper changing stations mentioned heretofore and many novel features that result in a new portable changing apparatus for an infant which is not anticipated, rendered obvious, suggested, or even implied by any of the prior art portable diaper changing stations, either alone or in any combination thereof.

There has thus been outlined, rather broadly, the more important features of the portable changing apparatus for an infant in order that the detailed description thereof that follows may be better understood, and in order that the present contribution to the art may be better appreciated. There are additional features of the invention that will be described hereinafter and which will form the subject matter of the claims. appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable changing apparatus for an infant which has many of the advantages of the portable diaper changing stations mentioned heretofore and many novel features that result in a new portable changing apparatus for an infant which is not anticipated, rendered obvious, suggested, or even implied by any of the prior art portable diaper changing stations, either alone or in any combination thereof.

Still another object of the present invention is to provide a new portable changing apparatus for an infant for allowing a user to easily change diapers on a baby on outings, in particular.

Still yet another object of the present invention is to provide a new portable changing apparatus for an infant that is easy and convenient to set up and use.

Even still another object of the present invention is to provide a new portable changing apparatus for an infant that can be carried along and be used in rest areas and other unsightly conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
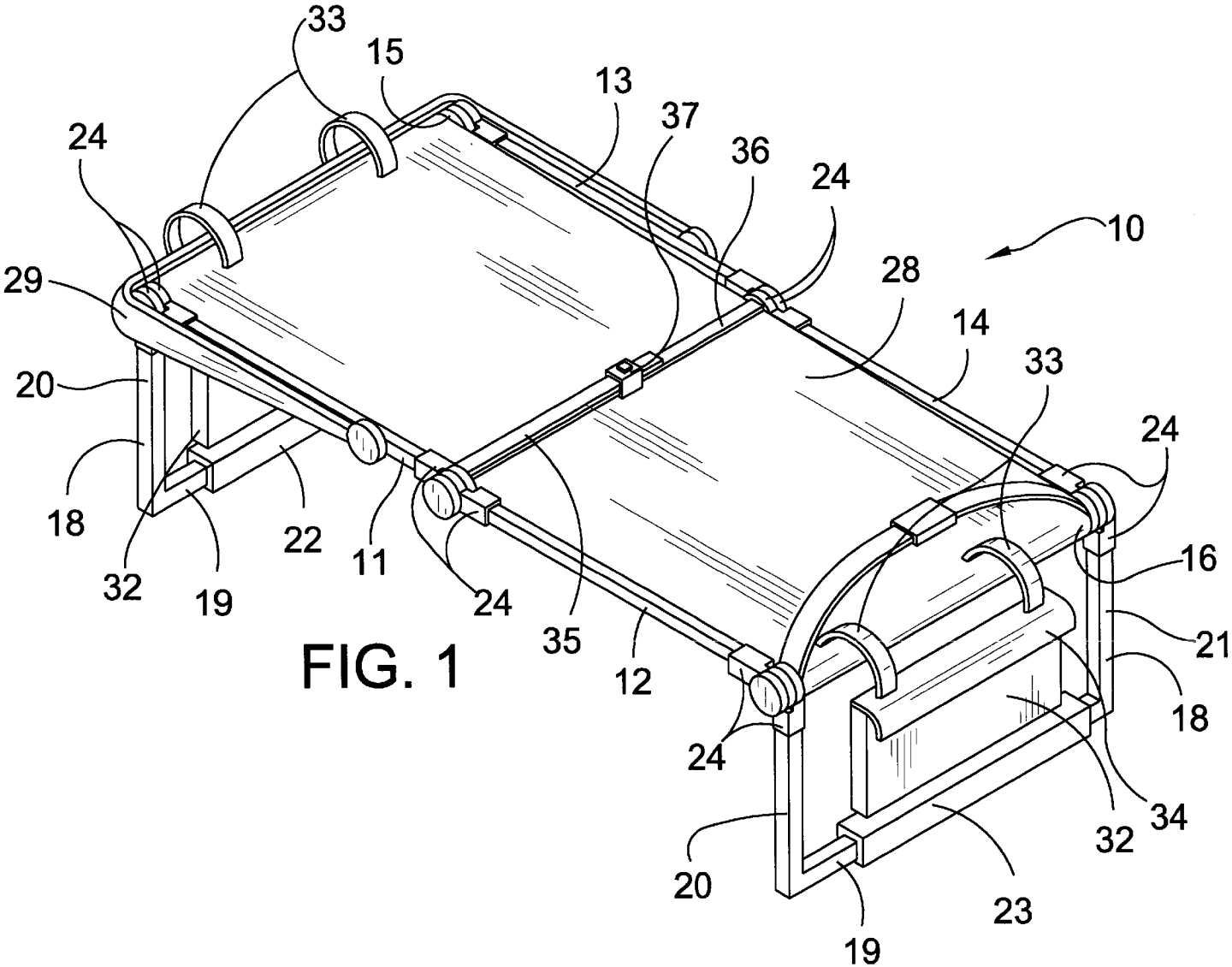
FIG. 1 is a perspective view of a new portable changing apparatus for an infant according to the present invention and shown in use.
Figure 2:
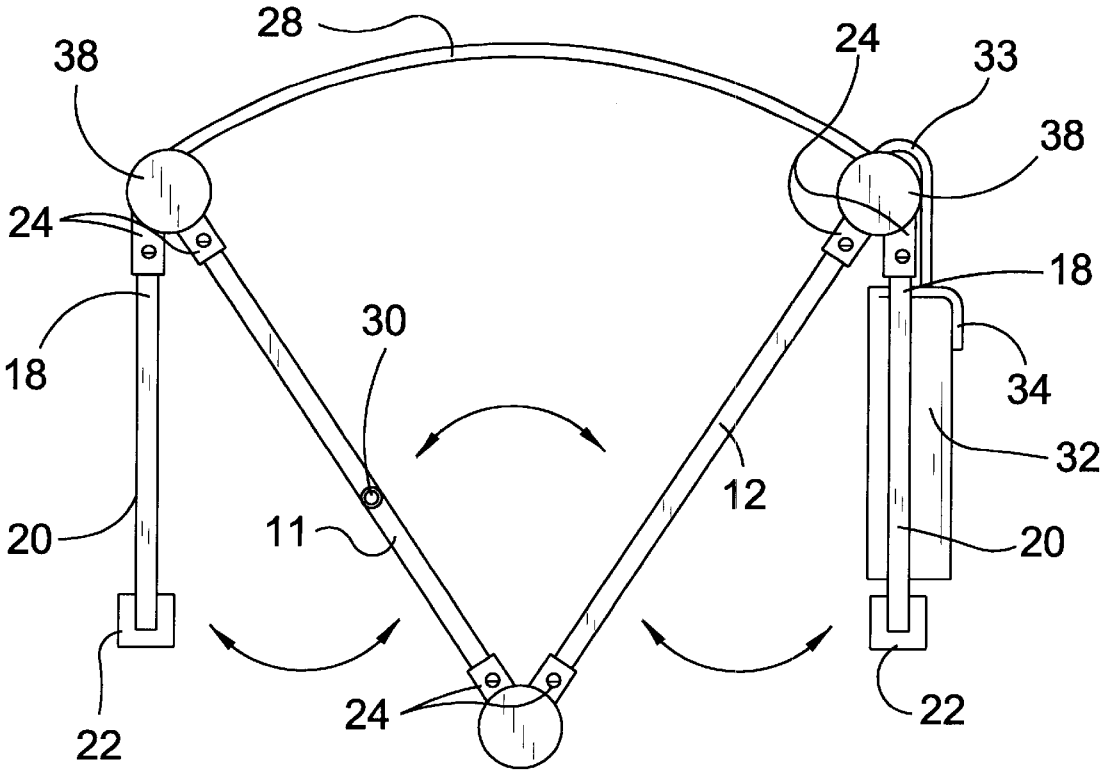
FIG. 2 is a side elevational view of the present invention being folded.
Figure 3:
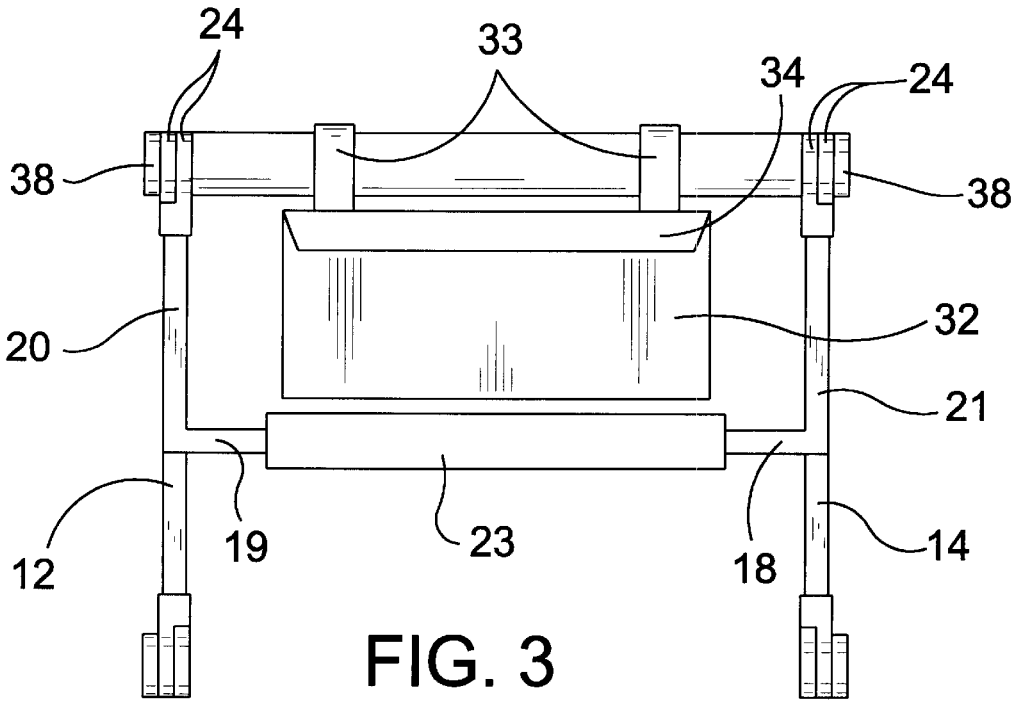
FIG. 3 is an end elevational view of the present invention.
Figure 4:
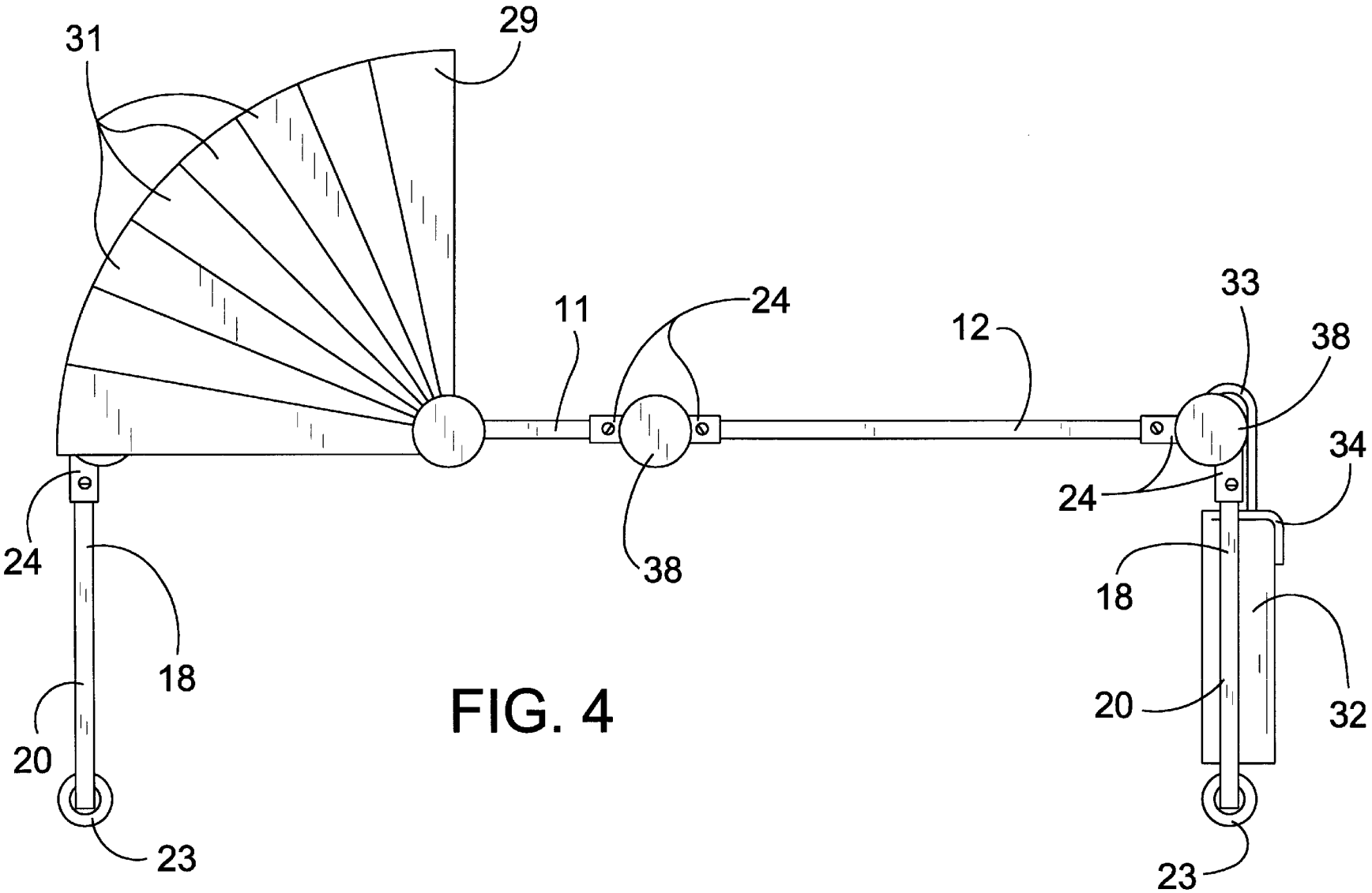
FIG. 4 is a side elevational view of the present invention.
Figure 5:
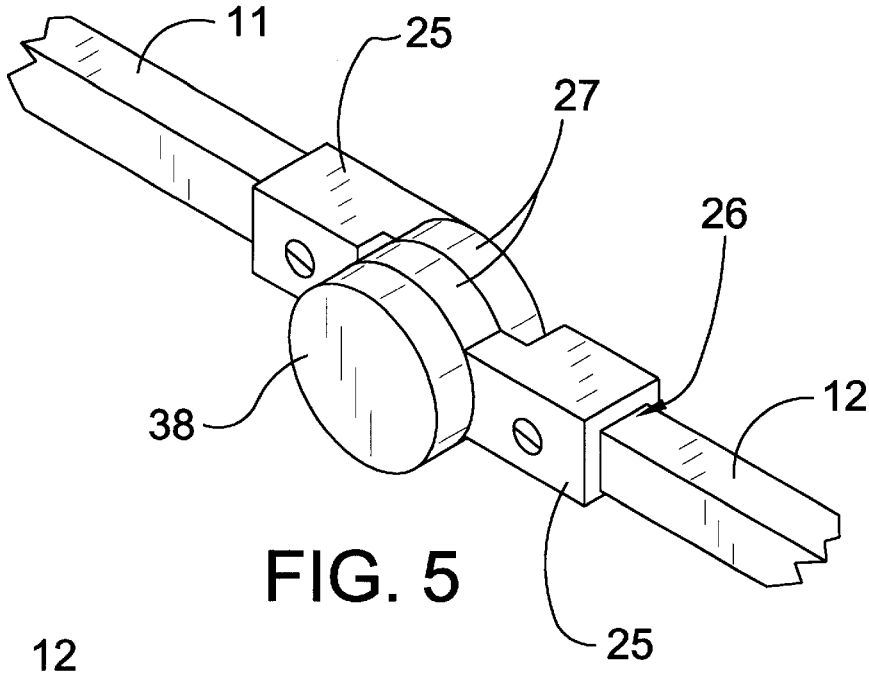
FIG. 5 is a detail perspective view of one of the hinge members of the present invention.
Figure 6:
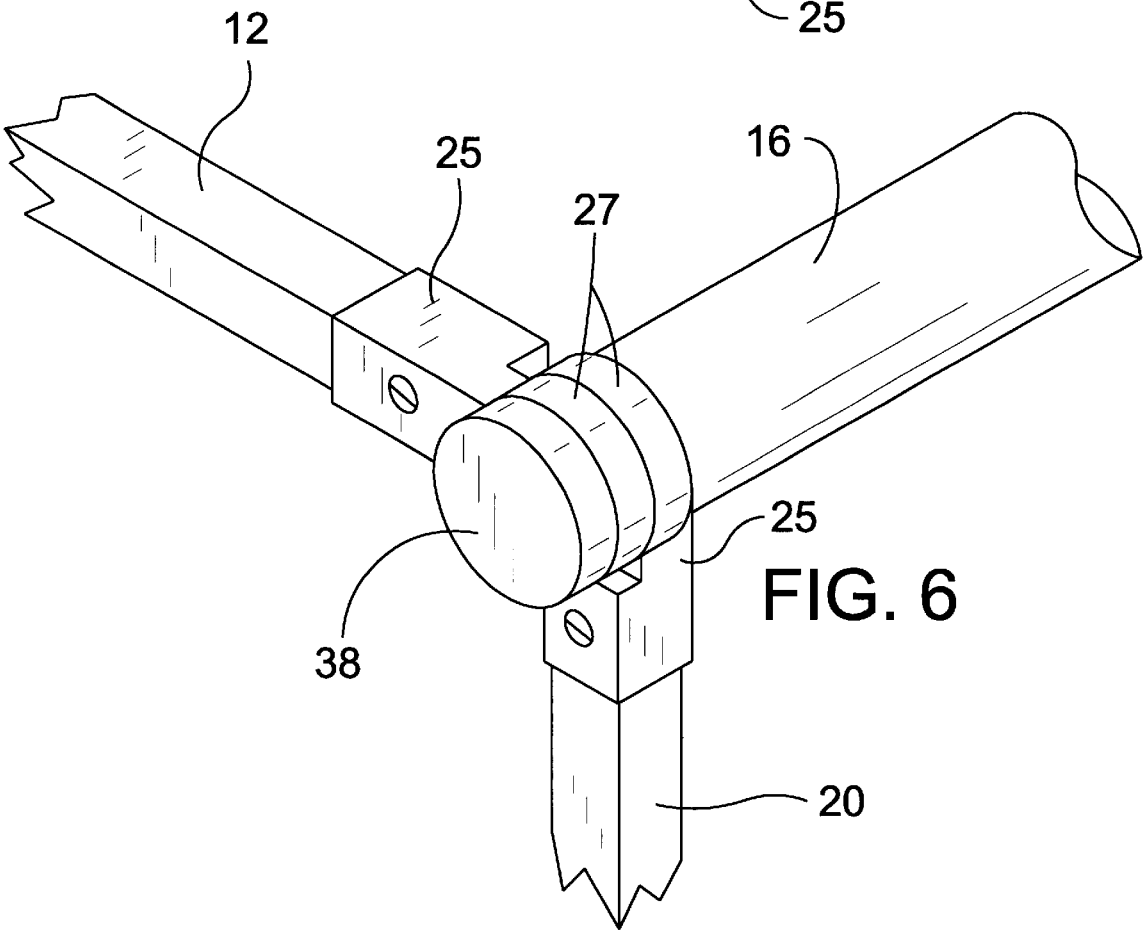
FIG. 6 is a detailed perspective view of another one of the hinge members of the present invention.

With reference now to the drawings, and in particular to FIGS. 1 through 6 thereof, a new portable changing apparatus for an infant embodying the principles and concepts of the present invention and generally designated by the reference numeral 10 will be described.

As best illustrated in FIGS. 1 through 6, the portable changing apparatus for an infant 10 generally comprises a frame assembly capable of being folded. The frame assembly includes pairs of elongate side members 11–14 each of which includes respective elongate side members 11–14 being hingedly attached to one another, and also includes a plurality of elongate cross members 15,16 conventionally interconnecting the elongate side members 11–14.

A leg assembly is hingedly attached to and foldable upon the frame assembly. The leg assembly includes leg members 18 being hingedly attached at ends of the pairs of elongate side members 11–14. Each of the leg members 18 includes an elongate main portion 19 and also includes elongate end portions 20 being angled relative to the elongate main portion 19 and being hingedly attached to the frame assembly. The leg assembly further includes padded sleeves 22,23 which are removably mounted about the elongate main portions 19 of the leg members 18.

A hinge assembly for folding the frame assembly and the leg assembly includes hinge members 24 being attached and fastened at ends of the pairs of elongate side members 11–14 and at ends of the elongate end portions of the leg members 18, and also includes hinge members 24 being attached and fastened to and interconnecting the elongate side members 11–14 of the pairs of elongate side members. Each of the hinge members 24 includes a tubular portion 25 having an open end 26 and removably and securely receiving a respective end of the pairs of elongate side members 11–14 and of the elongate end portions 20 of the leg members 18 and of the elongate side members 11–14 of the pairs of elongate side members, and also includes an eyelet portion 27 being integrally attached at an opposite end of the open end 26 of the tubular portion 25 with pairs of the eyelet portions 27 being fastened together with conventional fastening members 38.

A sheet of material 28 is conventionally attached to the frame assembly and is adapted for an infant to lie upon. The sheet of material 28 is a canvas which is disposed within the frame assembly between the elongate cross members 15–16 and the elongate side members 11–14.

A hood assembly is conventionally attachable to the frame assembly. The hood assembly includes a hood member 29 being removably attached to the frame assembly, and also includes a fastener 30 being conventionally attached to one of the elongate side members 11,13 of each of the pairs of elongate side members 10–14 for securing the hood member 29 to the frame assembly. The hood member 29 includes a plurality of arcuate hood sections 31 being telescopingly interrelated and having ends which are fastened to the frame assembly.

A storage unit is removably and conventionally secured to the frame assembly. The storage unit includes pouch members 32 having a flap 34 for closing the pouch members 32, and also includes pouch support members 33 being conventionally attached to the pouch members 32 and being removably attached to the frame assembly with the pouch members 32 being adapted to carry accessories used in changing an infant.

A child restraining member is adjustably attached to the frame assembly. The child restraining member includes a first strap 35 being conventionally attached to the frame assembly, and also includes a second strap 36 also being conventionally attached to the frame assembly and being fastenable together about an infant lying on the sheet of material 28, and further includes a buckle member 37 for adjustably fastening the first and second straps 35,36 together.

In use, the user folds the elongate side members 11–14 and the leg members 18 so that the portable changing apparatus for an infant 10 is in a compact carrying position. To change the diaper of the infant, the user unfolds the elongate side members 11–14 and the leg members 18 and places the portable changing apparatus for an infant 10 upon a suitable level surface, and then places the infant upon the sheet of material 28 and secures the infant to the sheet of material 28 using the first and second straps 35,36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable changing apparatus for an infant. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable changing apparatus for an infant comprising:

a frame assembly capable of being folded, and including pairs of elongate side members each of which includes respective said elongate side members being hingedly attached to one another, and also includes a plurality of elongate cross members interconnecting said elongate side members;

a leg assembly being attached to and foldable upon said frame assembly, said leg assembly including leg members being hingedly attached at ends of said pairs of elongate side members, said leg members including an elongate main portion and also including elongate end portions being angled relative to said elongate main portion and being hingedly attached to said frame assembly, said leg assembly further including padded sleeves which are removably mounted about said elongate main portions of said leg members;

a hinge assembly for folding said frame assembly and said leg assembly, said hinge assembly including hinge members being attached at ends of said pairs of elongate side members and at ends of said elongate end portions of said leg members, and also including hinge members being attached to and interconnecting said elongate said members of said pairs of elongate side members, wherein each of said hinge members includes a tubular portion having an open end and removably and securely receiving a respective end of said pairs of elongate side members and of said elongate end portions of said leg members and of said elongate side members of said pairs of elongate side members, and also includes an eyelet portion being attached at an opposite end of said open end of said tubular portion, pairs of said eyelet portions being fastened together with fastening members;

a sheet of material being attached to said frame assembly and being adapted for an infant to lie upon;

a hood member removably attachable to said frame assembly;

a storage unit being removably secured to said frame assembly; and an adjustable child restraining member being attached to said frame assembly.

2. A portable changing apparatus for an infant as described in claim 1, wherein said sheet of material is a canvas which is disposed within said frame assembly between said elongate cross members and said elongate side members.

3. A portable changing apparatus for an infant as described in claim 1, wherein said hood member includes a fastener being attached to one of said elongate side members of each of said pairs of elongate side members for securing said hood member to said frame assembly.

4. A portable changing apparatus for an infant as described in claim 3, wherein said hood member includes a plurality of arcuate hood sections being telescopingly interrelated and having ends which are fastened to said frame assembly.

5. A portable changing apparatus for an infant as described in claim 1, wherein said storage unit includes pouch members having a flap for closing said pouch members, and also includes pouch support members being attached to said pouch members and being removably attached to said frame assembly, said pouch members being adapted to carry accessories used in changing an infant.

6. A portable changing apparatus for an infant as described in claim 1, wherein said child restraining member includes a first strap being attached to said frame assembly, and also includes a second strap also being attached to said frame assembly and being fastenable together about an infant lying on said sheet of material, and further includes a buckle member for adjustably fastening said first and second straps together.

* * * * *